US008434958B2

(12) United States Patent
Rademacher

(10) Patent No.: US 8,434,958 B2
(45) Date of Patent: May 7, 2013

(54) APPLICATION SYSTEM

(75) Inventor: Lothar Rademacher, Bietigheim-Bissingen (DE)

(73) Assignee: Dürr Systems GmbH, Bietigheim-Bissingen (DE)

( * ) Notice: Subject to any disclaimer, the term of this patent is extended or adjusted under 35 U.S.C. 154(b) by 470 days.

(21) Appl. No.: 12/740,903

(22) PCT Filed: Nov. 5, 2008

(86) PCT No.: PCT/EP2008/009317

§ 371 (c)(1), (2), (4) Date: Apr. 30, 2010

(87) PCT Pub. No.: WO2009/059753

PCT Pub. Date: May 14, 2009

(65) Prior Publication Data

US 2010/0260531 A1 Oct. 14, 2010

(30) Foreign Application Priority Data

Nov. 7, 2007 (DE) ..... 10 2007 053 073

(51) Int. Cl.
*B43K 5/02* (2006.01)
*B43K 5/18* (2006.01)

(52) U.S. Cl.
USPC ..... 401/146; 401/148; 401/188 R

(58) Field of Classification Search ..... 401/188 R, 401/187, 146; 239/587.1; 427/427.3; 118/692
See application file for complete search history.

(56) References Cited

U.S. PATENT DOCUMENTS 7,140,559 B2 * 11/2006 Giulano ..... 239/436
8,028,651 B2 * 10/2011 Rademacher et al. ..... 118/684
2010/0291310 A1 * 11/2010 Hartmann et al. ..... 427/427.3

* cited by examiner

*Primary Examiner* — David Walczak
*Assistant Examiner* — Jennifer C Chiang
(74) *Attorney, Agent, or Firm* — Bejin VanOphem Bieneman PLC

(57) ABSTRACT

An application system is disclosed, e.g., for the application of a sealing, adhesive or other coating material having a high viscosity, for example, on vehicle bodies. An exemplary application system may include an application robot fitted with an applicator having at least one application nozzle for the coating material, and a dosing device for general dosing of the coating material applied by the application nozzle, as may be desired. An exemplary dosing device may include a screw pump or a spiral pump that is built into or onto the applicator, or into or onto a robot arm of the displacement machine.

15 Claims, 3 Drawing Sheets

APPLICATION SYSTEM

CROSS-REFERENCE TO RELATED APPLICATIONS

This application is a National Phase application claiming the benefit of International Application PCT/EP2008/009317, filed Nov. 5, 2008, which claims priority to German Patent Application No. DE10 2007 053 073.2, filed Nov. 7, 2007, the complete disclosures of which are hereby incorporated in by reference in their entireties.

BACKGROUND

The present disclosure relates to an application system, e.g., for the in series application of a high viscosity coating material such as, for example, sealing, adhesive, insulating or similar material. In addition, the present disclosure relates to a corresponding application robot and a corresponding applicator for this system.

When coating workpieces such as for example vehicle bodies or parts thereof with coating compositions such as sealants, for example for seam sealing, or adhesives or preservatives such as for example wax or laminating agents or indeed insulating materials etc., in many cases metering of the material fed to the applicator needs to be as precise as possible. The viscosity of such coating compositions, for which the applicator of an exemplary system is intended to be suitable, is significantly greater than for example the viscosity of liquid paint measured using the same measurement method. If for example using the measurement method standardised to standard series DIN 53019 the viscosity of water-based paints is measured, which in accordance with the thixotropic behaviour of such coating materials is to a considerable extent dependent on the shear rate, typical values of between 50 and around 200 mPas (at 20° C.) are obtained for example for a shear rate (flow rate of the measurement sample relative to the width of a shear gap in which the liquid flows) of 1000/s. The coating compositions to be applied according to the exemplary illustrations herein have, in contrast, a correspondingly measured viscosity of more than 300 mPas, typically more than 500 mPas. The likewise thixotropic material used for vehicle bodies for sealing and the other stated purposes may for example typically have a viscosity measured using the stated method of 1.5 Pas to 7 Pas (or more than twice these values, if the shear rate amounts to just 100/s for example, instead of 1000/s). The applicator of the application system according to the exemplary illustrations herein is intended to be suitable for coating material the viscosity of which, measured using the same measurement method, amounts to, in some illustrations, at least 5 times, in particular at least 7 times, the viscosity of liquid paint such as especially the paints conventional in vehicle painting.

The conventional paint atomisers such as for example a rotary atomiser with built-in metering gear pump (DE 10115463 A1) are not suitable for application of the high viscosity coating compositions here under consideration in particular for vehicle bodies. Instead, a particularly suitable method for applying sealing seams is the "airless spraying method", in which, in contrast to rotary atomisation or air atomisation of paint, the material is atomised at the application nozzle by the material pressure alone. For the exemplary illustrations, however, known air-assisted applicators are also suitable for large-area material application, as is necessary for underbody sealant application or for spraying of insulation material. A factor common to the different applicators suitable according to the present disclosure is that they operate with significantly higher material pressure than conventional paint atomisers, wherein the material pressure at the application nozzle may typically lie between 15 bar and 230 bar, depending on nozzle type and material, while the material pressure at the outlet of the metering device or of the metering pump, which is higher due to inevitable pressure losses, may amount in typical cases to between 25 bar and 350 bar and is thus considerably higher than in paint application systems. As a rule, the application system according to the exemplary illustrations is thus intended to operate with a material pressure of at least 15 bar at the application nozzle and/or at least 25 bar at the outlet of the metering device or metering pump.

Metering may be effected in a demand-dependent manner, i.e. during coating the volumetric flow rate (through-flow per unit time) of the coating material fed to the applicator has to be very precisely variable with short response times as a function of the respective sub-zones of the workpiece, the respective setpoints being saved in the higher-level installation control means and predetermined thereby. In many cases, metering accuracy should amount to at least ±1% of the setpoint, with good repeatability under temperature, viscosity and pressure fluctuations. Because of the level of accuracy needed, continuous volume control may be required. With sealing applications in particular, it is important to avoid pulsing during application. The components of the metering system must as far as possible be free of dead spaces, inter alia to avoid curing. Particular requirements apply when metering special coating materials such as for example NAD material (non-aqueous polymer dispersion), for which inter alia special measuring devices are needed, or with materials for which a high metering pressure is reached during application, for example up to 400 bar in the case of PU. Different conditions arise with regard to volumetric flow rate, i.e. flow rate, which may in typical cases amount to for example between 2 and 50 ccm/sec. Further requirements relate to the admissible rise and response times of the system (<40 ms to reach ±5% of the setpoint), freely programmable adjustability of the admission pressure with short response time (<100 ms) and automatic dynamic adaptation of the admission pressure in the event of changes in the viscosity of the coating material, the possibility of automatic calibration in the event of material changes and short delay times at the start of operation. In general, not only the costs of the installation and maintenance thereof but also the weight and dimensions of system components, in particular with respect to mounting in or an application robots, should be as low as possible.

If, for example, an application robot is to be used to seal a weld or edge-formed seam of the workpiece, application generally has to be controlled such that not only is the quantity of material required in each case precisely metered but also the predetermined start and end points of the material seam are precisely observed. Because of the in practice relatively rapid application movements of a robot, very precise control of application on and off times is necessary therefor.

In the field of vehicle body coating, it has in practice been conventional, unlike in paintshops, to use discontinuous metering devices to meter high viscosity coating compositions, or indeed "pressure regulators", which are relatively light and may therefore also be mounted on the application robot. However, such devices generally operate with only low metering accuracy and at the same time with low metering dynamics or response rate. In addition, they are generally not capable of at least briefly increasing the pressure required at the application nozzle independently of the material supply in such a way as may in many cases be necessary, or of reducing the pressure prior to the start of application, as may likewise be necessary. Furthermore, discontinuous metering systems have further fundamental disadvantages such as refill time losses, long cycle times or a small metering range.

A metering system usable inter alia for sealants and adhesives is generally known from WO 2004/041444 and consists substantially of a continuous metering piston or gear pump and a second metering stage connected downstream thereof in the form of a cylinder container, the contents of which are held by a piston between two predetermined levels. Like other generally known piston metering devices, this metering system is so bulky and heavy, at least if sufficient metering precision is to be achieved, that it cannot be mounted on or in an application robot, because the load-carrying capacity thereof would be exceeded and/or its motion dynamics and in many cases the reachability of the workpiece areas to be coated, for example in the interior of a vehicle body, would be impaired. This has the significant disadvantage of undesirably long hose connections between the metering device and the applicator, with the consequence of a reduction in metering accuracy and metering dynamics, inter alia because of the known problems of hose "breathing". Long hoses also have the further disadvantage of correspondingly high material losses during a rinsing or cleaning process or of material settling problems, in particular if the material is not constantly circulating as far as the applicator.

Robots and applicators suitable for the application of sealing material to vehicle bodies are also generally known inter alia from U.S. Pat. No. 6,053,434 and EP 1 521 642. The applicators of these robots consist substantially of a tubular lance part, on the outer end of which an arrangement of for example three alternatively selectable nozzles are located. For each nozzle a control valve for the material fed to the applicator from outside is fitted in the applicator, with which control valve (for instance corresponding to the main needle function of conventional paint atomisers) application on and off times and thus the start and end points of the applied material course are controlled.

The object of the present disclosure is to achieve the shortest possible connection between the metering device and the applicator and the precisest possible metering and application while avoiding the disadvantages of known systems for high viscosity material, e.g., without significantly impairing the movement machine with regard to load carrying capacity, motion dynamics and/or the reachability of the workpiece zones to be coated. It is intended to achieve these aims with the least possible cost.

BRIEF DESCRIPTION OF THE FIGURES

The exemplary illustrations are explained in greater detail with reference to the drawings, in which.

DETAILED DESCRIPTION

Figure 1:
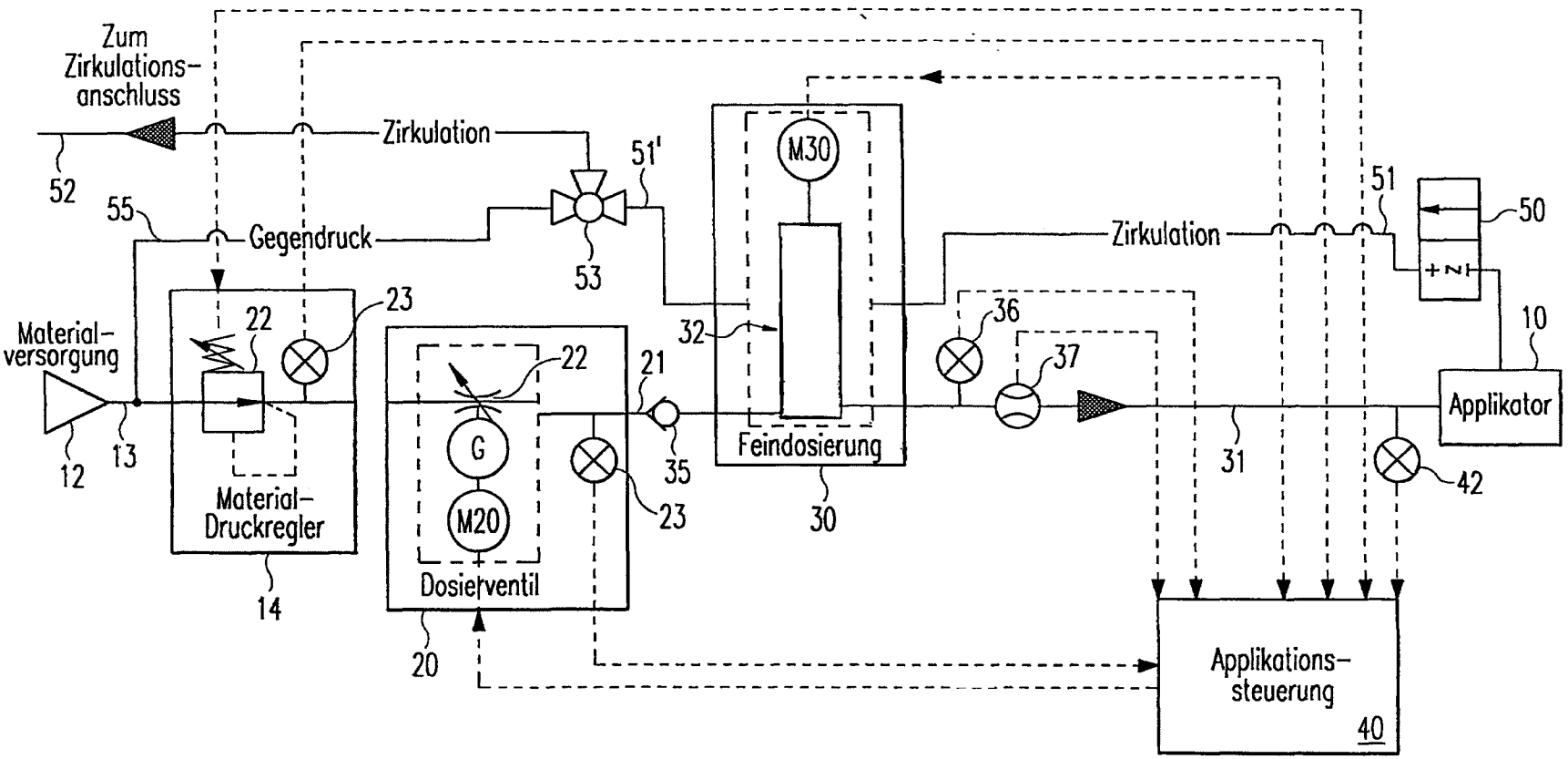
FIG. 1 shows a two-stage metering system suitable for the exemplary illustrations.

When incorporating the metering pump into a robot arm, e.g., into the upper arm of a conventional two-armed robot or into the forearm thereof, the hose length may be reduced to a correspondingly short piece up to the applicator at the robot wrist. The application and metering dynamics which may be achieved are accordingly high. It is also ideal to fit the metering pump into the applicator itself, since its outlet may then be connected directly without hose connection to the nozzle arrangement.

The metering pump may be able itself to generate a desired material pressure at least briefly independently of its inlet-side material supply pressure, said material pressure being if necessary also significantly higher than its inlet pressure. In addition, the delivery direction of the metering pump may be reversible, such that it is also capable of briefly reducing the outlet-side pressure, i.e. the admission pressure at the applicator, independently of the material supply pressure. This may be convenient towards the end of a material seam, in particular when the metering pump is incorporated into a robot arm, so that when application is subsequently switched on again no excess material arises as a result of relaxation of the hose connection to the application nozzle.

As a further convenient characteristic, the metering pump may be generally self-sealing when stationary, such that even at a high input pressure no material leaves its outlet. This characteristic makes it possible to control material delivery through the nozzle by switching the metering pump itself on and off and to dispense with the control valve controlled by external signals which has necessarily to be connected upstream of the nozzle in known applicators. This possibility arises in particular when the metering pump is incorporated into the applicator and with the most direct possible connection of the nozzle to the outlet of the metering pump. In this way, both the control valve itself and its control drive and thus components contributing to space requirements, weight and complexity of the application and/or of the robot arm would be dispensed with, which may be a significant advantage with just one nozzle and especially with a plurality of nozzles, each of which previously needed its own control valve.

Since the metering pump is mounted, in one exemplary illustration, in a robot arm or even better on or in the applicator itself, it may be as small and light as possible despite the possibility of generating high pressure and of high metering accuracy.

According to one exemplary illustration, the metering pump is a rotating positive-displacement pump and in particular a pump operating with at least one rotating screw or worm. Such rotating positive-displacement pumps are known as screw pumps, spiral pumps or eccentric screw pumps and are commercially available.

As has already been mentioned above, a metering device or metering pump in the system described herein means a delivery means with which the volumetric flow rate, i.e. the volume of coating material delivered per unit time, may be varied automatically during application for example as a function of the respective subzones being coated at that moment of the component to be coated. This demand-dependent variation of the feed rate may be achieved with piston metering devices by demand-dependent control of the piston speed, while in rotating positive-displacement pumps it may be achieved by controlling the speed of rotation, in particular by program control.

As has likewise already been mentioned, the high dispensing accuracy important in practice and the elevated pressures required at the nozzle for high viscosity coating materials can generally only be achieved in known systems with bulky, heavy dispensing devices with complex drive systems, which cannot as a rule be incorporated, as described in some exemplary illustrations, into conventional application robots or even into the applicator itself. A convenient option for being able to use a relatively simple, small metering pump and nevertheless achieving the necessary metering accuracy is the use of a two-stage metering system, as is described in principle in patent application EP 07 009 228.3/EP 1 854 548 of Aug. 5, 2007, the full contents of which are hereby expressly incorporated by reference in their entireties. This system substantially includes a controlled first metering device, which adjusts the pressure or the volumetric flow rate of the coating material to be applied by the applicator as a function of setpoints, which may be predetermined for said metering device by an automatic installation control means, a measuring sensor for producing a measured value, which corresponds to the pressure or volumetric flow rate of the coating material flowing to the applicator, a control device for controlling the first metering device as a function of the predetermined setpoints and of the measured value of the measuring sensor and a second metering device connected to the outlet of the first metering device for the coating material flowing to the applicator, which second metering device controls the pressure flow or volumetric flow rate as a function of the predetermined setpoints for precision metering of the applied coating material. The first metering device and/or the second metering device serving for precision metering may be controlled in each case by their own, e.g., closed, control loop, which compares a measured value corresponding to the pressure or the volumetric flow rate of the coating material flowing to the applicator with the predetermined setpoints. It may be advantageous for the first metering device to be controlled by a closed control loop, which includes an actuator for adjusting the pressure or the volumetric flow rate of the coating material flowing to the second metering device as a function of the setpoints compared with the actual value.

This metering system may be produced with low construction, control and maintenance costs as a pure throughflow system with the possibility of continuous endless metering, and in contrast with known continuous systems has the advantage of maximum possible metering accuracy (e.g., generally less than 1% deviation from the setpoint). Comparable accuracy has previously only been achievable with discontinuous piston metering devices. The system operates according to the master-slave principle with the first metering stage as the master and the second metering stage as the slave. For the first metering stage, an advantageously simple, compact, low-cost, low-maintenance metering device of a known type may be used, such as for example a low-wear and low-maintenance flow governor with a metering valve as actuator or indeed an even simpler metering pressure regulator. For the second metering stage necessary for precision metering, it is in contrast possible according to the exemplary illustrations to use the rotating screw or spiral pump or another rotating positive-displacement pump of the application system described herein.

The essential advantages of the exemplary illustrations are thus first of all the shortest possible connection between the metering device and the applicator and extremely precise metering (e.g., <1%), targeted adjustability of the admission pressure of the nozzle during reverse operation of the metering pump and high metering dynamics in particular with rapid brush changes, i.e. rapid responses to changes in the parameters controlling coating, such as for example pressure and/or volumetric flow rate of the material flowing or sprayed out through the nozzle. In addition, endless metering is possible, whereby production capacity may be increased when coating workpieces. If appropriate pumps are used, metering of abrasive materials is also possible. From a structural point of view, the metering pump may be externally or internally fitted in a compact, space-saving manner, and the external mountings for metering devices, which are a problem with many known systems, may be dispensed with.

The exemplary illustrations are generally suitable for any desired high viscosity material, specifically both for one- and for two-component material. In the latter case, the two components may be mixed in any manner known in a chamber provided in the applicator. It is likewise possible to apply two components at the same time to the workpiece, for example sealing and adhesives at the same time in a single operation.

The metering system illustrated in FIG. 1 is generally designed such that it may be used optionally both for pressure control and for volumetric flow control. Not all the components are thus necessary for the particular instance.

The coating material to be applied by an applicator 10, for example sealing material required for vehicle bodies or the parts thereof, may be fed from a material supply device 12 through an inlet line 13 and a material pressure regulator 14 to a first metering device 20 and thence through a connecting line 21 to a second metering device 30. From the outlet of the second metering device 30 the coating material may flow through a line 31, for example a hose line, to the inlet of the applicator 10. The material is conveyed by the pressure prevailing in the lines 13, 21 and 31. The broken lines represent, for example, electrical or pneumatic signal control lines.

The material pressure regulator 14 serves to adjust the admission pressure of the metering system at the material inlet of the first metering device 20 and includes for this purpose an adjusting valve 22 connected into the inlet line 13 and an associated pressure sensor 23. The adjusting valve 22 may be controlled in any manner known by an associated control device (not shown), included in the application control means 40, in the closed control loop as a function of the actual pressure value, which is measured by the pressure sensor 23 at the material outlet of the adjusting valve 22, and a predetermined desired admission pressure setpoint. The material pressure regulator 14 is here set to a constant material pressure, which is greater than the maximum pressure in the system necessary for application operation.

The first metering device 20 may include a metering valve 22 connected into the connection line 21, which metering valve serves in a manner generally known as the actuator for a closed control loop and for a for example electrical reversible motor M20 with associated gear train G, and its own pressure sensor 23, which measures the pressure at the material outlet of the metering valve 22. An associated control device (not shown) likewise included in the application control means 40 may control the motor M20 as a function of the actual pressure value of the pressure sensor 23 and/or as a function of an actual-value sensor at the outlet of the second metering device 30 and of the setpoints compared in the usual way with the actual value. The setpoints may be varied as required for the desired metering of the coating material during application and predetermined for the control loop by the higher-level automatic installation control means (not shown).

The second metering device 30 may generally serve for precision metering of the coating material and may include a rotating positive-displacement pump 32, which may be driven by a reversible motor M30 in both directions of rotation and may operate as the actuator of a closed control loop. The connecting line 21 may contain a non-return valve 35 between the material outlet of the first metering device 20 and the material inlet of the second metering device 30, in order to prevent a pressure kick-back to the metering valve 22 in the event of extra pressure build up by the precision metering device.

A further pressure sensor 36 may be connected to the material outlet, connected to the applicator 10 via line 31, of the precision metering device, which pressure sensor feeds the actual pressure value measured thereby to a further control device (not shown) in the application control means 40, which, with one possible mode of operation of the system, may compare the actual value with pressure setpoints predetermined by the higher-level installation control means (and corresponding to the desired outflow quantity on application) and may feed corresponding control signals to the motor M30 of the precision metering device. If the pressure of the coating material is too low, it is raised by the drive, while pressure which is too high is lowered by the motor M30.

During intervals in application it may be convenient to use the measured value of the pressure sensor 36 acting directly on the precision metering device in the case of the above-described mode of operation according to another function also to adjust the static pressure in the system, i.e. at the material inlet of the precision metering device. This static pressure may be adjusted by a control device contained in the application control means 40.

According to the exemplary illustration shown in FIG. 1, in addition to the pressure sensor 36 at the material outlet of the cylinder unit 32 a flow measuring cell 37 is connected into the line 31, which, in the case of a similarly feasible mode of operation of the system, measures the volumetric flow rate of the coating material flowing to the applicator 10 and feeds this actual value to the associated control device in the application control means 40. By comparing this actual value with set-points for the volumetric flow rate required at that moment or with appropriately converted pressure setpoints, the control device may thus actuate the cylinder unit 32, which serves as actuator, of the second metering device 30 to control volumetric flow directly.

Since the flow measuring cell 37 measures the volumetric flow rate of the coating material flowing to the applicator 10, which is the result obtained from both metering devices 20 and 30, it may further be convenient to actuate in addition the control loop for the first metering device using the measured value from the flow measuring cell 37. With knowledge of the respective pressures at the two metering devices, both control loops can be separately controlled. The measured values from the flow measuring cell 37 may be converted into corresponding pressure values in the application control means 40.

If no control system controlled by the volumetric flow rate is to be implemented, but rather an exclusively pressure-controlled metering system, the flow measuring cell 37 could also be dispensed with. According to a further exemplary illustration, not shown, it is however possible on the other hand also to actuate the first metering device connected upstream of the precision metering device as a direct function of the volumetric flow rate measured, for example, in the connecting line 21.

It may be assumed in the case of the functions described above that the pressure or volumetric flow rate measured values at the outlet of the second metering device 30 are in a precisely definable relationship to the corresponding values directly at the applicator 10. This relationship may be determined during installation or calibration of the coating installation and then may generally remain unchanged, while negative influences such as hose "breathing" may be compensated in any manner convenient, e.g., as generally provided in EP 1 481 736 and EP 1 298 504. Intrinsically variable factors such as temperature changes and the viscosity of the coating material used may also be taken into account mathematically in the application control means 40 by known relationships. Similarly, fixed relationships between pressure and volumetric flow rate and/or outflow quantity may be saved in the application control means when the system is calibrated.

It may however also be convenient to connect an additional pressure sensor 42 directly to the material inlet of the applicator 10. The measured value from this pressure sensor 42 is not necessary for actual metering control in accordance with the above explanations, but it may assist, for example in the application control means 40 in the event of adaptation of the system, in eliminating the influence of temperature and/or viscosity. In other cases, it may be convenient on the other hand to effect control with the help of a pressure sensor at the applicator, for example for particularly rapid control of the metering system.

If no material is being applied, it is in many cases convenient not to interrupt the material flow from line 31 to the applicator 10 but to return the coating material continuously in a circulation loop to the material supply upstream of the device 12, for example to prevent changes in the material or settling of the material. The circulation loop may pass through the applicator 10, e.g., in a manner generally known for coating installations. To this end, the line 31 leading to the applicator 10 may be connected to a return line 51 by way of a switching valve 50, which is closed during application and is opened in intervals in coating. The circulation loop does not however have to go as far as the applicator 10 or even—as in this exemplary embodiment—all the way through the applicator 10. As an alternative, the possibility exists for an application robot of the circulation loop extending only as far as one of the robot arms, for example as far as the forearm (robot axis 3).

In the exemplary illustration shown, the circulation loop may pass through the metering device 30, and an outlet line 51' then forms the continuation of the circulation loop. The outlet line 51' is connected to the 3-way valve 53 shown, from which the circulation loop continues back to the circulation connection 52 upstream of the inlet of the material supply device 12. If the circulation loop does not pass through the metering device 30, the switching valve 53 may be dispensed with and the back pressure in the second cylinder chamber 39 may be derived by the line 55 directly from the material supply.

Figure 2:
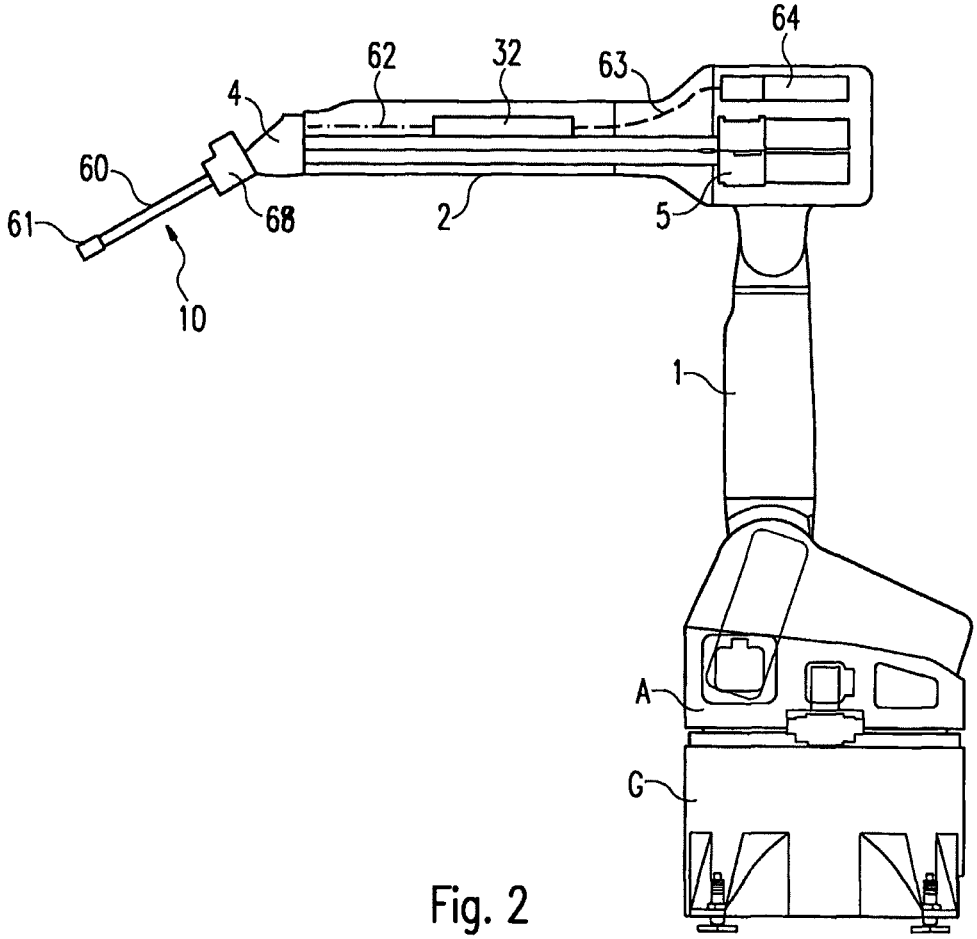
FIG. 2 is a schematic view of an application robot according to an exemplary illustration.

The 6-axis application robot shown schematically in FIG. 2 generally includes a base member G with a rotatable drive housing A, on which the swivellable arrangement of the arms 1 and 2 is mounted. The drive motors for the rotary motion of the drive housing A and for the swivel motion of the arm 1 are located in the drive housing, while the drive motor for the arm 2 may be fitted in the arm 1. The applicator 10 with the elongate, for example tubular, lance part 60 typical for example for sealing application may be mounted on, in this example, a 3-axis wrist structure 4 of the arm 2, the nozzle arrangement 61 with one or more nozzles selectable in any manner that is convenient being arranged at the outer end of said lance part. The three axes of the wrist structure 4 may be driven by three motor and gear units 5 arranged in conventional fashion at the rear end of the arm 2, for example mounted on a rear wall of the arm 2, and in each case having a shaft extending through the arm 2. The applicator 10 may be one of the above-mentioned spray apparatuses operating airlessly or with air assistance, which, in contrast with the conventional rotary or other paint atomisers, are suitable for the higher viscosity coating agents to be applied as described in the exemplary illustrations and to this end operate with a markedly higher material pressure.

In the exemplary illustration shown, the metering pump 32, indicated only schematically, is generally incorporated into the arm 2, said metering pump being for example a screw pump of the slim, elongate structure typical of this type of pump. This metering pump is connected to the applicator 10 via a relatively short hose piece 62 (not shown), which may be passed through the arm 2 and through the wrist structure 4 or indeed be positioned externally. The material supply line (not shown) leading to the metering pump 32 may also optionally extend inside the robot arm. For program-controlled drive of the metering pump 32, the latter may be connected to the drive motor 64 (corresponding to M30 in FIG. 1) via a further shaft 63 extending through the arm 2 and optionally a gear train. The drive motor 64 of the metering pump, for example an electrical or pneumatic servo or other motor, may likewise conveniently be arranged at the rear end of the arm 2, for example next to the motor and gear units 5 or indeed transversely thereof. The metering pump drive may thus in this respect, and optionally also with regard to the motor type, at least in principle correspond to the structure and arrangement of a conventional robot axis drive. In other cases it may however be more practical to mount the drive motor 64 directly on the metering pump 32. The exemplary illustrations are not limited to the example shown of a 6-axis robot; fewer or more axes and for example also a wrist with fewer or more than three axes may also be provided.

It may be convenient to incorporate the program control necessary for metering pump drive directly into the robot control means already present in itself, such that no significant expenditure on an additional application control means is needed. It is likewise possible for the metering pump drive to have its own application control means. The metering pump drive may in this respect simply be treated control-wise like an (optionally additional) robot axis.

With another exemplary illustration (not shown) the metering pump could also be incorporated into the robot at another location, for example in the arm 1, the drive motor thereof likewise being located for example in or on the arm 1 or indeed in the drive housing A.

Figure 3:
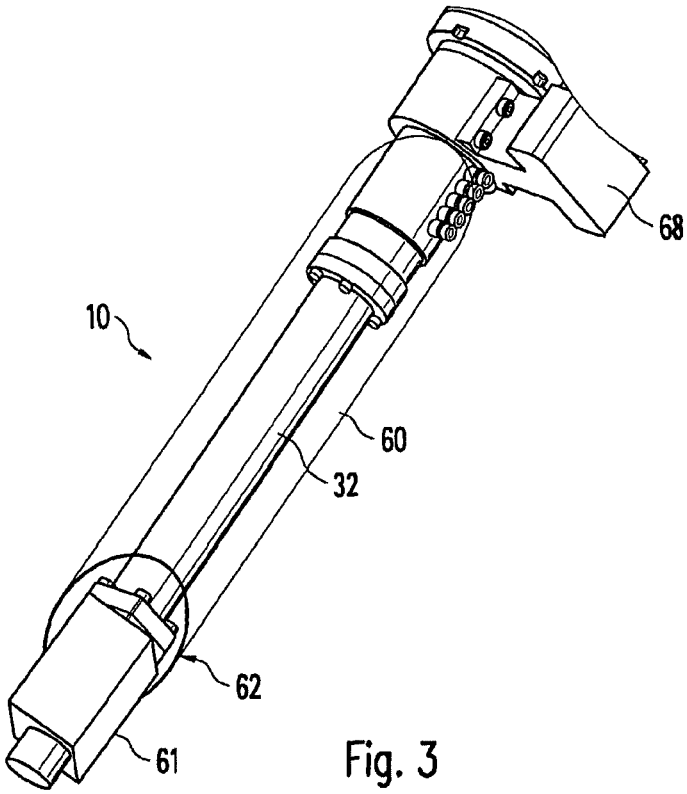
FIG. 3 shows an exemplary illustration of an applicator.

As shown in the arrangement of the metering pump 32, shown schematically in FIG. 3, in the lance part 60 of the applicator 10, the outlet of the metering pump 32 may be connected to the nozzle arrangement 61 at 62 directly and without a hose connection and, as a particular possibility, also without intermediate connection of a valve controlled by external signals for switching application on and off. The applicator 10 may be mounted with its connection block 68 on the robot wrist (not shown in FIG. 3). The drive motor of the metering pump 32 may likewise be located in the applicator directly on the pump or, failing that, in or on the arm 1 of the robot. The same may apply for a drive shaft and the material supply line of the metering pump 32 as for FIG. 2.

The arrangement, illustrated schematically in FIG. 3, of a pump in particular of the above-mentioned exemplary type in (or on) an applicator may also be convenient and advantageous for other purposes than the application and metering system actually described here, for example simply as a delivery device for any desired fluids. This arrangement is thus not restricted to the other features of the exemplary illustrations described herein.

The exemplary illustrations are not limited to the specific examples described above. Rather, a plurality of variants and modifications are possible, which likewise make use of the concepts of the exemplary illustrations and therefore fall under the scope of protection. Reference in the specification to "one example," "an example," "one embodiment," or "an embodiment" means that a particular feature, structure, or characteristic described in connection with the example is included in at least one example. The phrase "in one example" or "in an exemplary illustration" in various places in the specification does not necessarily refer to the same example or illustration each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

The invention claimed is:

1. An application system for the application of a high viscosity coating material to components, said application system comprising:

a program-controlled multi-axis movement machine, an applicator mounted on the movement machine and suitable for the high viscosity coating material, wherein said applicator includes an arrangement with at least one application nozzle for the coating material, and a metering device adapted for demand-controlled metering of the coating material applied by the application nozzle with a volumetric flow rate variable during application, wherein the metering device includes a continuously delivering metering pump that has an outlet that connects directly and without a hose connection to the at least one application nozzle.

2. The application system according to claim 1, wherein the metering pump is a rotating positive-displacement pump.

3. The application system according to claim 1, wherein the metering pump is one of a screw pump and a spiral pump.

4. The application system according to claim 1, wherein the direction of rotation or delivery of the metering pump is reversible.

5. The application system according to claim 1, wherein the metering pump is connected to the application nozzle directly without intermediate connection of a valve controllable by external control signals for switching the application on and off.

6. The application system according to claim 1, wherein an automatically controllable drive motor of the metering pump is mounted on or in an arm of the movement machine or the applicator.

7. The application system according to claim 1, wherein a drive shaft of the metering pump is passed through an arm of the movement machine and/or through the wrist, bearing the applicator, of the movement machine.

8. The application system according to claim 1, wherein the movement machine includes an associated first program control, and the metering pump includes an associated second program control, wherein the second program control of the metering pump is incorporated into the first program control of the movement machine.

9. The application system according to claim 1, further comprising a two-stage metering system, including:

a controlled first metering device configured to adjust the pressure or the volumetric flow rate of the coating material to be applied by the applicator as a function of one or more setpoints, the one or more setpoints being predetermined for said metering device by an automatic installation control means, a measuring sensor for producing a measured value, which corresponds to the pressure or the volumetric flow rate of the coating material flowing to the applicator, a control device for controlling the first metering device as a function of the predetermined setpoints and of the measured value of the measuring sensor, and a second metering device connected to the outlet of the first metering device for the coating material flowing to the applicator, which second metering device controls the pressure or volumetric flow rate of the applied coating material as a function of the predetermined setpoints for metering of said coating material.

10. The application system according to claim 9, wherein the first metering device and/or the second metering device serving for precision metering are controlled in each case by their own control loop, which compares a measured value corresponding to the pressure or the volumetric flow rate of the coating material flowing to the applicator with the predetermined setpoints.

11. The application system according to claim 9, wherein the first metering device is controlled by a closed control loop, wherein said closed loop includes an actuator for adjusting the pressure or the volumetric flow rate of the coating material flowing to the second metering device as a function of the setpoints compared with the actual value.

12. The application system according to claim 1, wherein the application system is adapted for coating vehicle bodies.

13. The application system according to claim 1, wherein said movement machine is an application robot.

14. An application system for the application of a high viscosity coating material to components, said application system comprising:

a program-controlled multi-axis movement machine, an applicator mounted on the movement machine and suitable for the high viscosity coating material, wherein said applicator includes an arrangement with at least one application nozzle for the coating material, and a metering device adapted for demand-controlled metering of the coating material applied by the application nozzle with a volumetric flow rate variable during application, wherein the metering device includes a continuously delivering metering pump, and further wherein the metering pump is mounted in or incorporated into an elongate lance part of the applicator, the nozzle arrangement being located at an outer end of said lance part.

15. An application system for the application of a high viscosity coating material to components, said application system comprising:

a program-controlled multi-axis movement machine, an applicator mounted on the movement machine and suitable for the high viscosity coating material, wherein said applicator includes an arrangement with at least one application nozzle for the coating material, and a metering device adapted for demand-controlled metering of the coating material applied by the application nozzle with a volumetric flow rate variable during application, wherein the metering device includes a continuously delivering metering pump, which is mounted in or on the applicator or a movable arm of the movement machine; and further wherein the nozzle arrangement is mounted directly at the outlet of the metering pump, without a hose connection.

* * * * *